United States Patent [19]

Takahashi et al.

[11] Patent Number: 4,956,332

[45] Date of Patent: Sep. 11, 1990

[54] HEAT-SENSITIVE RECORDING MATERIAL

[75] Inventors: Yoshiyuki Takahashi, Kawasaki; Kunitaka Toyofuku, Sakura; Akiko Iwasaki, Urawa, all of Japan

[73] Assignee: Oji Paper Co., Ltd., Tokyo, Japan

[21] Appl. No.: 399,054

[22] Filed: Aug. 28, 1989

[30] Foreign Application Priority Data

Nov. 2, 1988 [JP] Japan ..... 63-276186

[51] Int. Cl.[5] ..... B41M 5/18

[52] U.S. Cl. ..... 503/209; 503/208; 503/225

[58] Field of Search ..... 427/150–152; 503/208, 209, 225

[56] References Cited

U.S. PATENT DOCUMENTS 4,539,578 9/1985 Igarashi et al. ..... 503/207
4,644,375 2/1987 Satake et al. ..... 503/208

FOREIGN PATENT DOCUMENTS 0289041 11/1988 European Pat. Off. ..... 503/209
58-72499 4/1983 Japan .
59-133094 7/1984 Japan .
63-274587 11/1988 Japan .

OTHER PUBLICATIONS

Beilsteins Handbuch Der Organischen Chemie (Drittes Erganzungswerk), 1967 VI 4402.

"Über die Synthese Ausgewählter Polyphenyläther und deren Eignung als Schmieröle", Spengler et al., *Deutsche Luft-und Raumfahrt,* Dec. 1968, pp. 1–51.

*Primary Examiner*—Bruce H. Hess

*Attorney, Agent, or Firm*—Armstrong, Nikaido, Marmelstein, Kubovcik & Murray

[57] ABSTRACT

A heat-sensitive recording material with an excellent recording sensitivity, heat stability and resistance to the whitening phenomenon, comprising a heat-sensitive color developing layer formed on a substrate sheet and containing, in addition to a colorless dye precursor, color developing agent and binder, a heat-fusible sensitizing agent consisting essentially of at least one member selected from 1,4-bis(p-tolyloxy)benzene, 1,4-bis(3′,4′-dimethylphenyloxy)benzene and 1,4-bis(3′,5′-dimethylphenyloxy)benzene, in an amount of 10% to 1,000% based on the weight of the color developing agent.

4 Claims, No Drawings

HEAT-SENSITIVE RECORDING MATERIAL

BACKGROUND OF THE INVENTION (1) Field of the Invention

The present invention relates to a heat-sensitive recording material. More particularly, the present invention relates to a heat-sensitive recording material having an excellent aptitude for a high speed recording, a high heat resistance, and a satisfactory whiteness.

(2) Description of the Related Art

Heat-sensitive recording materials in which a heat color-developing reaction of a colorless or light color leuco dye with an organic acid material, for example, a phenol compound or organic acid compound, is utilized are disclosed by, for example, Japanese Examined Patent Publication (Kokoku) Nos. 43-4160, 45-14039 and 48-27736, and are now widely used.

These heat-sensitive recording materials are advantageous in that colored images can be easily formed only by heating and the recording apparatus can be made relatively compact and small size, and thus are widely utilized as information-recording materials. Also, facsimile machines and printers for which the heat-sensitive recording materials are used have been greatly improved, and therefore, the formation of colored images at a very high speed, considered impossible or very difficult in the past, is now possible.

Due to the above-mentioned development of the high speed heat-sensitive recording machines, the heat-sensitive material to be used for the high speed recording machines must have an enhanced recording sensitivity, in comparison with conventional heat-sensitive recording materials, and many attempts have been made to meet the above-mentioned requirement. Most of these attempts relate to combinations of specific leuco dyes with the color developing agents, or to utilization of specific heat-fusible substances.

The heat-fusible substances are used as a sensitizing agent for the color developing reaction in the heat sensitive color developing layer and include, for example, the phenyl 1-hydroxy-2-naphthoate disclosed in Japanese Unexamined Patent Publication No. 57-191089, p-benzyl-biphenyl disclosed in Japanese Unexamined Patent Publication No. 60-82382, benzyl naphthyl ether disclosed in Japanese Unexamined Patent Publication No. 58-87094, dibenzyl terephthalate disclosed in Japanese Unexamined Patent Publication No. 58-98285, benzyl p-benzyloxybenzoate disclosed in Japanese Unexamined Patent Publication No. 57-201691, diphenyl carbonate and ditolyl carbonate disclosed in Japanese Unexamined Patent Publication No. 58-136489, m-terphenyl disclosed in Japanese Unexamined Patent Publication No. 57-89994, 1,2-bis(m-tolyloxy)ethane disclosed in Japanese Unexamined Patent Publication No. 60-56588, and 1,5-bis(p-methoxyphenoxy)-3-oxapentane disclosed in Japanese Unexamined Patent Publication No. 62-181183.

When a heat-sensitive color developing layer containing the heat-fusible sensitizing agent is heated, first the sensitizing agent is melted and the leuco dye and the color-developing agent is dissolved in the melt, whereby the molecule of the dissolved leuco dye and color-developing agent are mixed and reacted with each other to develop a color in the color developing layer.

Therefore, the heat-fusible sensitizing agent must have a proper melting point, preferably from 80° C. to 110° C., and be highly compatible with the leuco dye and the color developing agent.

Also, preferably the heat-fusible sensitizing agent does not cause a lowering of the whiteness of the heat sensitive color developing layer. Therefore, the heat-fusible sensitizing agent must be substantially insoluble in water and must not discolor the color developing layer.

When a certain type of conventional heat-fusible sensitizing agent is contained, a white powder-like substance appears on the resultant color developing layer, with a lapse of time; which is known as the color developing layer whitening phenomenon. The whitening phenomenon is believed to depend closely on the sublimating property of the heat-fusible sensitizing agent, and therefore, the heat-fusible sensitizing agent must have no or a very low sublimating property.

In a practical recording operation, frequently the heat sensitive recording materials are temporarily exposed to a high temperature of about 60° C. to about 70° C. Under such a condition, the heat-sensitive color-developing layer must exhibit a high heat stability and must not develop a color at that high temperature. Therefore, the heat fusible sensitizing agent must not affect the heat stability of the heat-sensitive color developing layer.

As stated above, many heat fusible sensitizing agents have been provided, but very few of them can meet all of the above-mentioned requirements, and thus a new type of heat fusible sensitizing agent is urgently required.

SUMMARY OF THE INVENTION

An object of the present invention is to provide a heat-sensitive recording material which has an excellent recording sensitivity, a satisfactory whiteness and resistance to the whitening phenomenon, and does not affect the heat stability of the heat-sensitive color developing layer, and thus is useful for recording high quality clear colored images, under high speed recording conditions.

This object can be realized by the heat-sensitive recording material of the present invention, which comprises a substrate sheet and a heat-sensitive color-developing layer formed on at least one surface of the substrate sheet and comprising a substantially colorless dye precursor, a color developing agent capable of reacting with the dye precursor under heating, to develop a color, a binder, and a heat-fusible sensitizing agent consisting essentially of at least one member selected from 1,4-bis(alkylphenyloxy)benzenes of the formulae (I), (II) and (III):

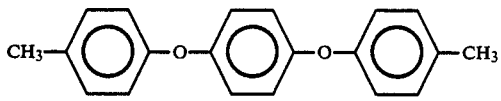

(I)

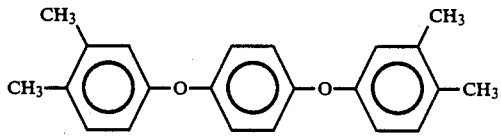

(II)

and

-continued

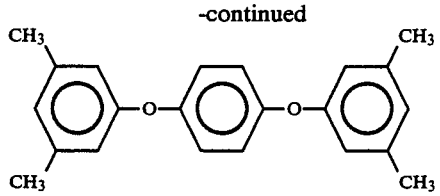

(III)

DESCRIPTION OF THE PREFERRED EMBODIMENTS

In the heat-sensitive recording material of the present invention, the heat-sensitive color developing layer must contain, in addition to a dye precursor, a color developing agent, and a binder, a heat-fusible sensitizing agent consisting essentially of at least one member selected from the 1,4-bis(alkylphenyloxy)benzenes of the formulae (I), (II) and (III):

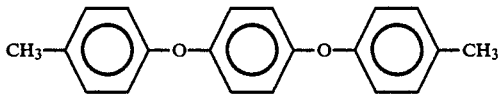

(I)

(1,4-bis(p-tolyloxy)benzene, m.p = 97° C.)

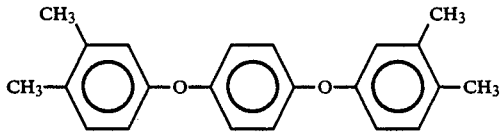

(II)

(1,4-bis(3',4'-dimethylphenyloxy)benzene, m.p = 106° C.) and

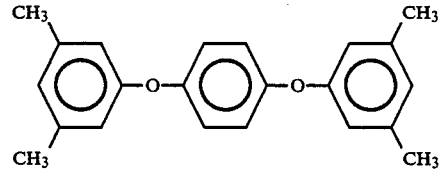

(III)

(1,4-bis(3',5'-dimethylphenyloxy)benzene, m.p = 103° C.)

The inventors of the present invention discovered that the compounds of the formulae (I), (II), and (III) effectively and significantly enhance the recording sensitivity and heat stability of the heat-sensitive color developing layer, without affecting the whiteness of the color developing layer or causing an undesirable whitening of the color developing layer, whereas the conventional heat fusible sensitizing agent consisting of a higher fatty acid amide, for example, stearylamide or palmitylamide, causes an unsatisfactory recording sensitivity of the resultant color developing layer.

The reasons why the compounds of the formulae (I), (II) and (III) enhance the recording sensitivity of the heat-sensitive color developing layer are not absolutely clear, but the following specific properties of the compounds are considered to be a factor thereof. When melted, the melts of the compounds of the formulae (I), (II) and (III) exhibit a relatively low viscosity and a high compatibility with the dye precursor and the color developing agent, and thus the dye precursor can easily react with the color developing agent in the melt, at a high reaction rate.

The absence of a lowering of the whiteness of the heat-sensitive color developing layer is assumed to be due to the very low or substantially non-solubility in water of the compounds of the formulae (I) to (III).

Also, the substantial absence of the whitening phenomenon is assumed to be due to a very low or substantially non-sublimating property of the compounds of the formulae (I) to (II) at practical printing temperatures.

Furthermore, the high heat-stability of the heat-sensitive color developing layer is due to a preferable melting point of the compounds of the formulae (I) to (III), which melting point is higher than a certain critical printing temperature.

The compounds of the formulae (I) to (III) can be produced by various synthetic method; i.e., usually the compounds can be easily produced by the Ullmann reaction and at a high yield in accordance with the following reactions:

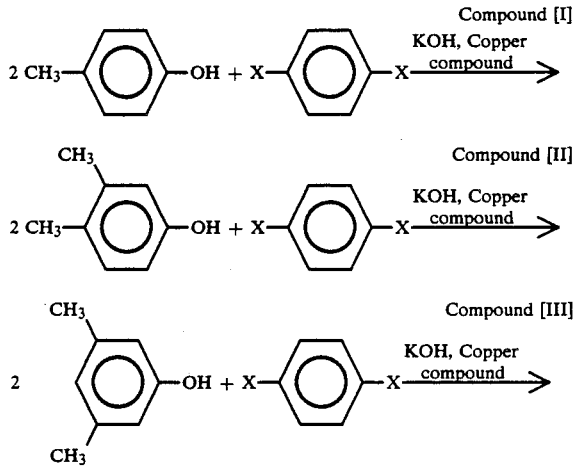

wherein X represents a halogen atom, for example, a chlorine, bromine or iodine atom.

Usually, the heat-fusible sensitizing agent in the present invention is contained in an amount of 10 to 1000% by weight, preferably 50 to 300% by weight, based on the weight of the color-developing agent.

The heat-sensitive color developing layer of the present invention contains a substantially colorless dye precursor, preferably in an amount of 5 to 20% by weight.

The substantially colorless dye precursor comprises at least one leuco basic dye which can be selected from usual leuco basic dyes usable for the conventional heat-sensitive color developing layer, for example, crystal violet lactone,
3-(N-ethyl-N-isopentylamino)-6-methyl-7-anilinofluoran,
3-diethylamino-6-methyl-7-anilinofluoran,
3-diethylamino-6-methyl-7-(o-, and p-dimethylanilino)-fluoran,
3-(N-ethyl-p-toluidino)-6-methyl-7-anilinofluoran,
3-pyrrolidino-6-methyl-7-anilinofluoran,
3-dibutylamino-6-methyl-7-anilinofluoran,
3-(N-cyclohexyl-N-methylamino)-6-methyl-7-anilinofluoran,
3-diethylamino-7-(o-chloroanilino)fluoran,
3-diethylamino-7-(m-trifluoromethylanilino)fluoran,
3-diethylamino-6-methyl-7-chlorofluoran,
3-diethylamino-6-methylfluoran, and
3-cyclohexylamino-6-chlorofluoran.

The color developing agent is usually contained in an amount of 10 to 40% by weight in the heat-sensitive color developing layer, and can be selected from conventional color developing agents.

Preferably, the color-developing agent usable for the present invention comprises at least one member selected from the group consisting of phenol compounds and organic acid compounds, for example, bisphenol A, benzyl p-hydroxybenzoate (Japanese Unexamined Patent Publication No. 52-140,483), bisphenol S, 4-hydroxy-4'-isopropyloxydiphenylsulfone (Japanese Unexamined Patent Publication No. 60-13852), 1,1-di(4-hydroxyphenyl)cyclohexane and 1,7-di(hydroxyphenylthio)-3,5-dioxaheptane (Japanese Unexamined Patent Publication No. 59-52694).

The heat-sensitive color developing layer of the present invention contains a binder in an amount of 5% to 20% by weight. The binder can be selected from conventional binders and preferably comprises at least one member selected from the group consisting of water-soluble polymeric materials, for example, polyvinyl alcohols having various molecular weights; starch and derivatives thereof; cellulose derivative, for example, methoxycellulose, carboxymethylcellulose, and methylcellulose; and water-soluble synthetic polymeric material, for example, sodium polyacrylate, polyvinylpyrrolidone, acrylamide-acrylic acid ester copolymers, acrylamide-acrylic acid ester-methacrylic acid terpolymers, styrene-aleic anhydride copolymer sodium salts, polyacrylamide, sodium alginate, geratine, and casein; and latexes of water-insoluble polymeric materials, for example, polyvinyl acetate, polyurethane, styrene-butadiene copolymers, polyacrylic acid, polyacrylic acid esters, vinyl chloride-vinyl acetate copolymers, polybutyl methacrylate, ethylene-vinyl acetate copolymers and styrene-butadiene, and acrylic monomers copolymers.

The heat-sensitive color developing layer of the present invention optionally contains an additional heat fusible sensitizing agent consisting of at least one conventional heat-fusible substance having a melting point of from 80° C. to 110° C., for example, the compounds disclosed in the Description of the Related Art of this specification. The additional sensitizing agent is preferably contained in an amount of 5 to 20%, based on the weight of the color developing agent.

The heat-sensitive color-developing layer of the present invention optionally contains 10 to 50% by weight of a white pigment comprising fine particles of at least one member selected from inorganic pigments, for example, calcium carbonate, silica, zinc oxide, titanium dioxide, aluminum hydroxide, zinc hydroxide, barium sulfate, clay, calcined clay, talc, and surface-treated calcium carbonate and silica; and organic pigments, for example, urea-formaldehyde resins, styrene-methacrylic acid copolymers, and polystyrene.

The heat-sensitive color-developing layer of the present invention optionally contains 5 to 30% by weight of a wax substance which can be selected from conventional wax materials, and preferably, comprises at least one member selected from, for example, paraffin materials, amide type wax materials, bis-imide type wax material, and metal salts of higher fatty acids.

Usually, the heat-sensitive color-developing layer of the present invention is preferably in a dry weight of 1 to 10 g/m$^2$, more preferably 2 to 7 g/m$^2$.

In the heat-sensitive recording material of the present invention, the heat-sensitive color developing layer is formed on at least one surface of a substrate sheet.

The substrate sheet comprises a paper sheet, a coated paper sheet in which a paper substrate sheet is coated with a mixture of an inorganic or organic pigment and a binder, a laminated paper sheet in which a paper substrate sheet is laminated with at least one heat-fusible resinous film, for example, polyethylene or polypropylene film, a synthetic paper sheet consisting essentially of a plastic resin, or a plastic resin film. The substrate sheet preferably has a weight of 30 to 200 g/m$^2$.

The heat-sensitive recording material of the present invention is prepared by coating at least one surface of the substrate sheet with a coating liquid comprised of the dye precursor, color developing agent, heat-fusible sensitizing agent, binder and optionally at least one additive, for example, a white pigment or wax substance, dissolved or dispersed in a volatile solvent, for example, water, and drying the resultant coating liquid layer on the substrate sheet.

EXAMPLES

The present invention will be further explained by way of specific examples, which are representative and do not in any way restrict the scope of the present invention.

SYNTHESIS EXAMPLE 1

Preparation of 1,4-bis(p-tolyloxy)benzene

A three-necked flask equipped with a distilling receiver and a magnetic stirrer was charged with 32.4 g (0.30 moles) of p-cresol, and 16.8 g (0.30 moles) of potassium hydroxide was added into the flask while stirring the resultant reaction mixture at a temperature of 150° C. to provide a potassium salt of p-cresol. To the resultant p-cresol potassium salt melt were gradually mixed 100 ml of toluene, and the resultant reaction mixture was subjected to azeotropic distillation to remove water from the reaction mixture. After 50 ml of toluene were distilled away, the remaining reaction mixture was mixed with a solution of 23.6 g (0.10 moles) of p-dibromobenzene dissolved in 10 ml of hot toluene, and then with a catalyst consisting of 2.0 g of anhydrous copper chloride (II), and the resultant reaction mixture was refluxed for 8 hours while stirring.

The reaction product was extracted from the reaction mixture with ether, the resultant ether phase was washed with an alkali solution, with an acid solution and then with water, and was dried by adding a desiccating agent. The resultant dried solution was filtered and then distilled to remove ether. A crude crystalline product obtained in an amount of 25.8 g was recrystallized in ethyl alcohol. The refined crystalline substance was in an amount of 21.0 g and exhibited a melting point of 97° C.

It was confirmed by nuclear magnetic resonance spectrometry and mass spectrometry that the resultant crystalline substance was 1,4-bis(p-tolyloxy)benzene.

SYNTHESIS EXAMPLE 2

Preparation of 1,4-bis(3',4'-dimethylphenyloxy)benzene

The same procedures as those in Synthesis Example 1 were carried out except that 32.4 g of p-cresol was replaced by 36.6 g of 3,4-dimethylphenol. A refined crystalline substance having a melting point of 106° C. was obtained in an amount of 27.7 g, it was confirmed by nuclear magnetic resonance spectrometry and mass spectrometry that the crystalline substance was 1,4-bis(3',4'-dimethylphenyloxy)benzene.

SYNTHESIS EXAMPLE 3

Preparation of 1,4-bis(3',5'-dimethylphenyloxy)benzene

The same procedures as those in Synthesis Example 1 were carried out except that 32.4 g of p-cresol were replaced by 36.6 g of 1,4-bis(3',5'-dimethylphenyloxy)-benzene. A refined crystalline substance having a melting point of 103° C. was obtained in an amount of 27.0 g.

It was confirmed by nuclear magnetic resonance spectrometry and mass spectrometry that the resultant crystalline substance was 1,4-bis(3',5'-dimethyl-phenyloxy)benzene.

SYNTHESIS EXAMPLEs 4

Preparation of comparative compounds

Comparative compounds (a) to (k) as indicated in Table 1 were prepared by a synthesizing method analogous to those mentioned in Synthesis Examples 1 to 3. Asymmetric compounds, for example, (b), (d), (e), and (f) were prepared in accordance with the following reaction route:

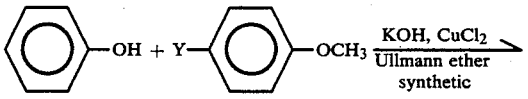

(1)

-continued

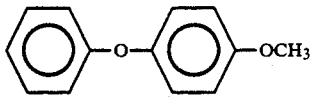

[IV]

(2)

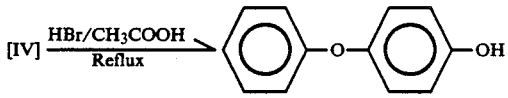

[V]

(3)

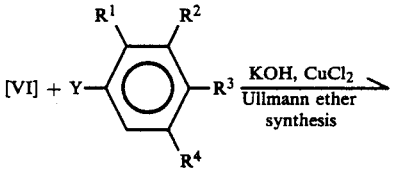

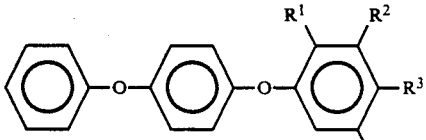

(a)-(k)

wherein Y represents a bromine atom and $R^1$, $R^2$, $R^3$ and $R^4$ represent, respectively and independently from each other, a member selected from the group consisting of a hydrogen atom and methyl and isopropyl groups.

TABLE 1

| Compound No. | Formula | Measured melting point (°C.) | Melting point given in literature*1 |
|---|---|---|---|
| (a) | 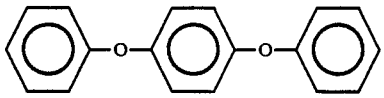 | 75° C. | 74–75° C. |
| (b) | 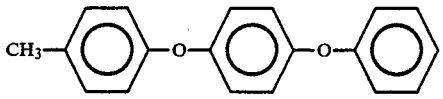 | 48° C. | 50–51° C. |
| (c) | 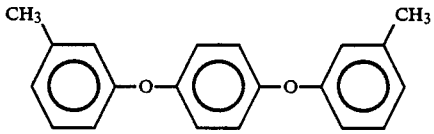 | 54° C. | 57–58° C. |
| (d) | 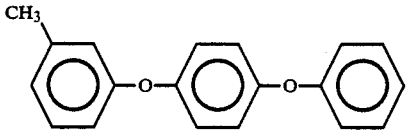 | liquid at room temperature*2 | 22–23° C. |
| (e) | 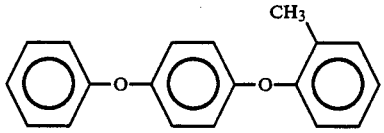 | liquid at room temperature*2 | 9° C. |

TABLE 1-continued

| Compound No. | Formula | Measured melting point (°C.) | Melting point given in literature*1 |
|---|---|---|---|
| (f) | 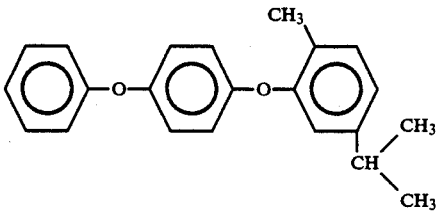 | Solid-liquid mixed state at room temperature*2 | 29–31° C. |
| (g) | 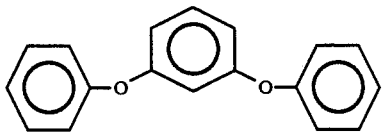 | 49° C. | 47° C. |
| (h) | 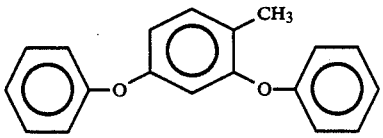 | liquid at room temperature*2 | 7–21° C. |
| (i) | 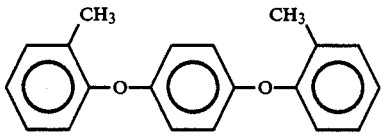 | 50° C. | 50–52° C. |
| (j) | 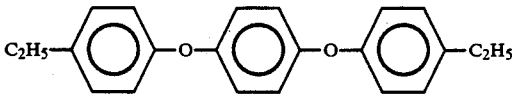 | 55° C. | 52–54° C. |
| (k) | 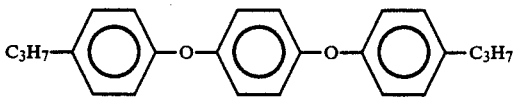 | 49° C. | 49–50° C. |

Note:
*1G. Spengler, M. Koll Deutsche Versuchsantalt fur Lufut- und Raum fahrt 1-51 (1968)
*2Compounds (d), (e), (f) and (h) which are in the state of a liquid at room temperature are useless for heat-sensitive recording sheet.

EXAMPLE 1

A heat-sensitive recording paper sheet was produced by the following procedures.

(1) Preparation of dye precursor dispersion A

A mixture having the composition as shown below was prepared.

| Component | Amount (part by wt) |
|---|---|
| 3-(N-isopentyl-N-ethylamino)-6-methyl-7-anilinofluoran | 20 |
| 10% polyvinyl alcohol aqueous solution | 10 |
| Water | 70 |

The mixture was placed in a sand grinder to pulverize the dye precursor particles to a size of 1 μm or less, and a dispersion A was obtained.

(2) Preparation of color developing agent dispersion B

A mixture having the composition indicated below was prepared.

| Component | Amount (part by wt) |
|---|---|
| 4,4'-isopropylidenebiphenol | 10 |
| 1,4-bis(p-tolyloxy)benzene | 10 |
| 10% polyvinyl alcohol aqueous solution | 10 |
| Water | 70 |

The mixture was placed in a sand grinder to pulverize the color developing agent particles to a size m or less, and a dispersion B was obtained.

(3) Formation of heat-sensitive color developing layer

A coating liquid was prepared by mixing 40 parts by weight of the dye precursor dispersion A, 160 parts by weight of the color developing agent dispersion B, 40 parts by weight of calcium carbonate pigment, 0 parts by weight of 30% parafin aqueous emulsion, and 180 parts by weight of a 10% polyvinyl alcohol aqueous solution while stirring. The resultant coating liquid was coated on a surface of a paper sheet having a weight of 50 g/m$^2$ to an extent such that, after drying and solidifying, the resultant dry coating layer was in a weight of 7.0 g/m$^2$, the coated liquid layer was dried to form a heat-sensitive color developing layer, and thus a heat-sensitive recording paper sheet was obtained.

The recording paper sheet was treated by a super calender to smooth the surface of the heat-sensitive color developing layer until it exhibited a Beck smoothness of 600 to 1000 seconds.

The calendered recording paper sheet was subjected to the following tests.

(1) Measurement of recording sensitivity and whiteness of colored image-free portion of the recording paper sheet.

A test piece of the recording paper sheet was locally heated at a temperature of 120° C. under a pressure of 2.5 kg/cm$^2$ for 100 m seconds, using a heat inclination tester (made by Toyo Seiki Co.), and the darkness of the resultant colored image was measured by a color darkness tester (available under a trademark of Macbeth Darkness Tester RD-914, from Kollmorgen Co.). The recording sensitivity of the test piece was represented by the measured value of the color darkness. Preferably, the measured darkness was 1.20 or more.

Also, the darkness (whiteness) of a portion of the test piece free from the colored image was measured in the same manner as mentioned above. The whiteness of the test piece after the colored image-formation was represented by the measured value of the darkness. The lower the measured darkness, the higher the whiteness of the test piece. Preferably the measured darkness was 0.12 or less.

(2) Measurement of heat stability

In the above-mentioned heat inclination tester, a test piece was heated at a temperature of 70° C. under a pressure of 2.5 kg/cm$^2$ for 5 seconds. The color development under the above-mentioned conditions refers to a static color development at 70° C. The darkness of the colored image was measured in the same manner as mentioned above.

The heat stability of the test piece at 70° C. was represented by the measured value of the darkness of the colored image. The lower the darkness, the higher the heat stability of the test piece, and preferably, the measured value of the darkness was 0.2 or less.

(3) Resistance to whitening phenomenon

A test piece was heated at a temperature of 150° C., using the above-mentioned heat inclination tester, to form a colored image.

The colored image-formed portion was left to stand for 24 hours at a temperature of 40° C. and a relative humidity of 90%. Thereafter, the surface of the colored image was observed by the naked eye and evaluated as follows.

| Indication | Notification |
|---|---|
| Good | No whitening phenomenon observed |
| Bad | Clear whitening phenomenon observed |

The results of the tests are indicated in Table 2.

EXAMPLE 2

The same procedures as in Example 1 were carried out with the following exceptions.

(1) Preparation of a pigment-coated paper sheet

An aqueous dispersion was prepared by dispersing 85 parts by weight of calcined clay in 320 parts by weight of water and was mixed with 40 parts by weight of a 50% aqueous emulsion of a styrene-butadiene copolymer and 50 parts by weight of a 10% aqueous solution of oxidized starch, to provide a pigment coating liquid.

A surface of a paper sheet having a weight of 48 g/m$^2$ was coated with the pigment coating liquid and the resultant pigment coating liquid layer was dried to form a dry pigment coating layer having a weight of 7.0 g/m$^2$.

(2) Formation of color developing layer

A coating liquid was prepared by mixing 50 parts by weight of the dye precursor dispersion A, 200 parts by weight of the color developing agent dispersion B, 25 parts by weight of calcium carbonate, 20 parts by weight of a 30% aqueous emulsion of paraffin, and 180 parts by weight of a 10% aqueous solution of polyvinyl alcohol, and stirring the mixture.

The coating liquid was applied to the pigment-coated surface of the paper sheet and the resultant coating liquid layer was dried to form a heat-sensitive color developing layer having a dry weight of 5.0 g/m$^2$. The resultant heat sensitive recording paper sheet was subjected to the same tests as in Example 1.

The test results are shown in Table 2.

EXAMPLE 3

The same procedures as those in Example 2 were carried out except that, in the preparation of the color developing agent dispersion B, 1,4-bis (p-tolyloxy)benzene was replaced by 1,4-bis(3',4'-dimethylphenyloxy)-benzene.

The test results are shown in Table 2.

EXAMPLE 4

The same procedures as those in Example 2 were carried out except that, in the preparation of the color developing agent dispersion B, 1,4-bis(p-tolyloxy)benzene was replaced by 1,4-bis(3',5'-dimethylphenyloxy)-benzene.

The test results are shown in Table 2.

COMPARATIVE EXAMPLE 1

The same procedures as in Example 2 were carried out except that, in the preparation of the color developing agent dispersion B, 1,4-bis(p-tolyloxy)benzene was replaced by the compound (a) indicated in Table 1.

The test results are shown in Table 2.

COMPARATIVE EXAMPLE 2

The same procedures as in Example 2 were carried out except that, in the preparation of the color developing agent dispersion B, 1,4-bis(p-tolyloxy)benzene was replaced by the compound (c) indicated in Table 1.

The test results are shown in Table 2.

COMPARATIVE EXAMPLE 3

The same procedures as in Example 2 were carried out except that, in the preparation of the color developing agent dispersion B, 1,4-bis(p-tolyloxy)benzene was replaced by the compound (g) indicated in Table 1.

The test results are shown in Table 2.

COMPARATIVE EXAMPLE 4

The same procedures as in Example 2 were carried out except that, in the preparation of the color developing agent dispersion B, 1,4-bis(p-tolyloxy)benzene was replaced by the compound (i) indicated in Table 1.

The test results are shown in Table 2.

COMPARATIVE EXAMPLE 5

The same procedures as in Example 2 were carried out except that, in the preparation of the color developing agent dispersion B, 1,4-bis(p-tolyloxy)benzene was replaced by the compound (j) indicated in Table 1.

The test results are shown in Table 2.

COMPARATIVE EXAMPLE 6

The same procedures as in Example 2 were carried out except that, in the preparation of the color developing agent dispersion B, 1,4-bis(p-tolyloxy)benzene was replaced by the compound (k) indicated in Table 1.

The test results are shown in Table 2.

COMPARATIVE EXAMPLE 7

The same procedures as in Example 2 were carried out except that, in the preparation of the color developing agent dispersion B, 1,4-bis(p-tolyloxy)benzene was replaced by phenyl 1-hydroxy-2-naphthoate.

The test results are shown in Table 2.

COMPARATIVE EXAMPLE 8

The same procedures as in Example 2 were carried out except that, in the preparation of the color developing agent dispersion B, 1,4-bis(p-tolyloxy)benzene was replaced by stearylamide.

The test results are shown in Table 2.

TABLE 2

| Example No. | Item | Recording sensitivity (D) | Whiteness (D) | Heat stability at 7° C. (D) | Whitening resistance |
|---|---|---|---|---|---|
| Example | 1 | 1.25 | 0.09 | 0.10 | Good |
| | 2 | 1.30 | 0.09 | 0.10 | Good |
| | 3 | 1.25 | 0.09 | 0.09 | Good |
| | 4 | 1.27 | 0.09 | 0.10 | Good |
| Comparative Example | 1 | 1.25 | 0.10 | 0.36 | Good |
| | 2 | 1.20 | 0.67 | 1.10 | Good |
| | 3 | 1.18 | 0.80 | 1.15 | Good |
| | 4 | 1.20 | 0.81 | 1.15 | Good |
| | 5 | 1.22 | 0.70 | 1.10 | Good |
| | 6 | 1.17 | 0.84 | 1.16 | Good |
| | 7 | 1.26 | 0.11 | 0.14 | Bad |
| | 8 | 1.00 | 0.11 | 0.15 | Good |

Table 2 clearly shows that the heat-sensitive recording paper sheets of the present invention exhibited an excellent recording sensitivity, a satisfactory whiteness of a colored image-free portion thereof, even after colored image formation, a superior heat stability at 70° C., and a satisfactory resistance to the whitening phenomenon, whereas the comparative recording paper sheet of Comparative Example 1 exhibited an unsatisfactory heat stability at 70° C., those of Comparative Example 2 to 6 had a very poor whiteness and heat stability at 70° C., that of Comparative Example 7 exhibited a significant whitening phenomenon, and that of Comparative Example 8 had an unsatisfactory recording sensitivity.

We claim:

1. A heat-sensitive recording material comprising:

a substrate sheet; and a heat-sensitive color-developing layer formed on at least one surface of the substrate sheet and comprising a substantially colorless dye precursor, a color developing agent capable of reacting with the dye precursor under heating to develop a color, a binder, and a heat-fusible sensitizing agent consisting essentially of at least one member selected from the 1,4-bis(alkylphenyloxy)benzenes of the formulae (I), (II) and (III):

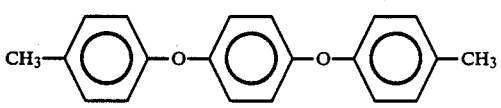

(I)

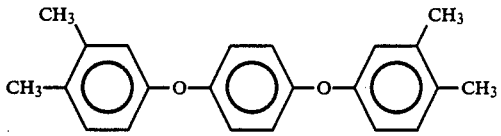

(II)

and

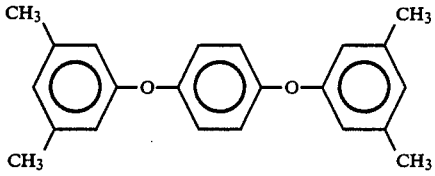

(III)

2. The heat-sensitive recording material as claimed in claim 1, wherein the heat-sensitive color developing layer is in an amount of 1 to 10 g/m$^2$.

3. The heat-sensitive recording material as claimed in claim 1, wherein the color-developing agent is in an amount of 10% to 40% based on the weight of the heat-sensitive color-developing layer.

4. The heat-sensitive recording material as claimed in claim 1, wherein the sensitizing agent is in an amount of 10% to 1,000% based on the weight of the color-developing agent.

* * * * *

UNITED STATES PATENT AND TRADEMARK OFFICE

CERTIFICATE OF CORRECTION

PATENT NO. : 4,956,332

DATED : September 11, 1990

INVENTOR(S) : TAKAHASHI et al

It is certified that error appears in the above-identified patent and that said Letters Patent is hereby corrected as shown below:

On the cover page, Item [30] after
"Nov. 2, 1988 [JP] Japan ..... 63-276186" insert
--Jul. 28, 1989 [JP] Japan ..... 1-194379--.

Signed and Sealed this

Seventh Day of January, 1992

*Attest:*

HARRY F. MANBECK, JR.

*Attesting Officer*

*Commissioner of Patents and Trademarks*